US009765498B2

(12) United States Patent
Mitola et al.

(10) Patent No.: US 9,765,498 B2
(45) Date of Patent: Sep. 19, 2017

(54) MANHOLE COVER LOCKS, LOCKABLE MANHOLE COVERS, AND METHODS FOR LOCKING A MANHOLE COVER

(71) Applicants: Anthony F. Mitola, Saratoga Springs, NY (US); Lawrence E. Jordan, Amsterdam, NY (US); Michael O'Donnell, Valhalla, NY (US); Joseph Vainauskas, Amsterdam, NY (US)

(72) Inventors: Anthony F. Mitola, Saratoga Springs, NY (US); Lawrence E. Jordan, Amsterdam, NY (US); Michael O'Donnell, Valhalla, NY (US); Joseph Vainauskas, Amsterdam, NY (US)

(73) Assignee: Utility Designs of New York LLC, Saratoga Springs, NY (US)

( * ) Notice: Subject to any disclaimer, the term of this patent is extended or adjusted under 35 U.S.C. 154(b) by 0 days.

(21) Appl. No.: 15/265,446

(22) Filed: Sep. 14, 2016

(65) Prior Publication Data

US 2017/0073921 A1 Mar. 16, 2017

Related U.S. Application Data

(60) Provisional application No. 62/248,160, filed on Oct. 29, 2015, provisional application No. 62/218,997, filed on Sep. 15, 2015.

(51) Int. Cl.

| | |
|---|---|
| ***E02D 29/14*** | (2006.01) |
| ***E05C 3/14*** | (2006.01) |
| ***E05C 19/00*** | (2006.01) |

(52) U.S. Cl.

CPC ..... *E02D 29/1427* (2013.01); *E02D 29/14* (2013.01); *E05C 3/14* (2013.01); *E05C 19/007* (2013.01)

(58) Field of Classification Search

CPC ..... E05C 19/009; E05C 19/04; E05C 19/007; E02D 29/1427; E02D 29/14; E05B 15/006; E05B 17/2011

See application file for complete search history.

(56) References Cited

U.S. PATENT DOCUMENTS 2,114,499 A * 4/1938 Maclear ..... E02D 29/1427 49/465
2,693,100 A * 11/1954 Wiegel ..... E02D 29/1427 292/64

(Continued)

OTHER PUBLICATIONS

Mitola et al., U.S. Appl. No. 115/424,553, filed Feb. 3, 2017, entitled, Lockable Manhole Covers, and Methods for Locking a Manhole Cover, 37-pages.

(Continued)

*Primary Examiner* — Abigail A Risic
(74) *Attorney, Agent, or Firm* — Heslin Rothenberg Farley & Mesiti P.C.

(57) ABSTRACT

A locking assembly attachable to a manhole cover includes an arm disposable in a lowered position with the arm disposed in a first orientation engageable with a manhole frame supporting the manhole cover to inhibit removal of the manhole cover from a manhole frame, and disposable in a raised position and in a second orientation operable to allow removal of the manhole cover from the manhole frame. In an embodiment, the locking assembly may include the arm attached to a movable member having a spiral, helix, or curved groove and in which the movable arm is receivable in a bushing and a pin receivable in the groove.

37 Claims, 9 Drawing Sheets

(56) References Cited

U.S. PATENT DOCUMENTS

| | | | | |
|---|---|---|---|---|
| 5,533,641 | A | 7/1996 | Argandona | |
| 6,764,261 | B1 * | 7/2004 | Stadler | E02D 29/1427 411/340 |
| 6,811,119 | B1 * | 11/2004 | Petersen | E02D 29/1427 244/114 R |
| 7,144,189 | B1 * | 12/2006 | Bongiovanni | B65D 90/105 404/25 |
| 7,484,908 | B2 | 2/2009 | Stadler | |
| 7,896,574 | B2 | 3/2011 | Nolle et al. | |
| 9,377,037 | B2 | 6/2016 | Daniels | |
| 9,416,516 | B2 | 8/2016 | Stadler | |
| 9,422,069 | B2 * | 8/2016 | Valicek | B65B 3/18 |
| 2004/0069024 | A1 * | 4/2004 | Hauer | E02D 29/1427 70/167 |
| 2007/0223997 | A1 * | 9/2007 | Fuchs | E02D 29/1427 404/25 |
| 2010/0028077 | A1 * | 2/2010 | Stadler | E02D 29/1436 404/25 |
| 2012/0054998 | A1 * | 3/2012 | Tschida | F16B 19/109 29/426.1 |
| 2013/0039716 | A1 * | 2/2013 | McClure | F16B 13/06 411/80.1 |
| 2013/0221688 | A1 * | 8/2013 | Stadler | E02D 29/1427 292/155 |

OTHER PUBLICATIONS

Metcalf et al., "Design of Sewers", American Sewerage Practice, vol. 1, , 1st Edition, New York,1914, p. 559.

* cited by examiner

MANHOLE COVER LOCKS, LOCKABLE MANHOLE COVERS, AND METHODS FOR LOCKING A MANHOLE COVER

CLAIM TO PRIORITY

This application claims the benefit of U.S. Provisional Application No. 62/218,997, filed Sep. 15, 2015, entitled "Manhole Cover Locks," and U.S. Provisional Application No. 62/248,160, filed Oct. 29, 2015, entitled "Manhole Cover Locks", which applications are hereby incorporated herein in their entirety by reference.

FIELD OF THE DISCLOSURE

The present disclosure relates generally to manhole covers, and more particularly to manhole cover locks, lockable manhole covers, and methods for locking a manhole cover.

BACKGROUND

Manhole covers made of cast iron make up the bulk of access covers in urban streets around the world. These covers have a proven record of durability, strength, and functionality. The high density of iron results in a cover of substantial weight preventing cover displacement during flooding conditions and minimizing the occurrence of theft.

Recently, gas or steam explosions below streets can cause manhole covers to become dangerous projectiles. For example, a cast iron manhole cover can weigh between 85 pounds and 300 pounds, and explosions can propel the cover from 1 foot to 50 feet into the air. Often during various events, particularly in large cities, utilities will temporary weld manhole covers to their manhole frames to prevent access in and out of the manhole.

SUMMARY

Shortcomings of the prior art are overcome and additional advantages are provided through the provision, in one embodiment, of a locking assembly for a manhole cover. The locking assembly includes, for example, a movable member having an upper portion and a lower portion, the upper portion supportable in an opening in a manhole cover adjacent to a peripheral edge of the manhole cover, an arm extending outwardly from the lower portion of the movable member and disposable below a bottom surface of the manhole cover. The movable member and the arm are disposable in a lowered position relative to the manhole cover with the arm engageable with a portion of a manhole frame below the manhole cover to inhibit removal of the manhole cover from the manhole frame. The movable member and the arm are disposable in a raised position relative to the manhole cover with the arm so that the manhole cover is removable from the manhole frame.

In another embodiment, a locking assembly for a manhole cover is provided. The locking assembly includes, for example, means, attachable to a manhole cover, for simultaneously moving and rotating an arm from a lowered position with the arm disposed at a first distance and at a first orientation relative to a bottom surface of the manhole cover so that the arm is engageable with a portion of a manhole frame to inhibit removal of the manhole cover from the manhole frame to a raised position with the arm disposed at a second distance less than the first distance and at a second orientation different from the first orientation relative to a bottom surface of the manhole cover so that the manhole cover is removable from the manhole frame.

In another embodiment, a locking assembly for a manhole cover is provided. The locking assembly includes, for example, a bushing attachable through an opening in the manhole cover adjacent to a peripheral edge, the bushing have a passageway therein, a pin inwardly extending into the passageway in the bushing, a movable member receivable in the bushing, the movable member having a groove for receiving the pin therein, and an outwardly-extending arm attached to a lower portion of the movable member. The locking assembly is disposable with the pin in the groove in a lowered position with the outwardly-extending arm disposed in a generally radially outward orientation operable to engage a frame supporting the manhole cover to inhibit removal of the manhole cover from the manhole frame. The locking assembly is disposable with the pin in the groove in a raised position with the outwardly extending arm disposed in a non-radially outwardly-extending orientation operable to allow removal of the manhole cover from the manhole frame.

In another embodiment, a lockable manhole cover is provided which includes, for example, a manhole cover, and the above-described locking assembly attachable to the manhole cover.

In another embodiment, a method is provided which includes, for example, providing the above noted locking assembly attached to the manhole cover in the second or raised position, positioning the manhole cover on a rim of the manhole frame, and moving the locking assembly to the first or lowered position to lock the manhole cover to the manhole frame.

In another embodiment, a method is provided which includes, for example, positioning a manhole cover disposed on a rim of a manhole frame, simultaneously downwardly moving and rotating an arm away from a bottom surface of the manhole cover so that the arm is engageable with the manhole frame to inhibit removal of the manhole cover from the manhole frame, and simultaneously upwardly moving and rotating the arm toward the bottom surface of the manhole cover so that the manhole cover is removable from the manhole frame.

BRIEF DESCRIPTION OF THE DRAWINGS

The subject matter which is regarded as the disclosure is particularly pointed out and distinctly claimed in the concluding portion of the specification. The disclosure, however, may best be understood by reference to the following detailed description of various embodiments and the accompanying drawings in which:

DETAILED DESCRIPTION

The present disclosure and certain features, advantages, and details thereof, are explained more fully below with reference to the non-limiting embodiments illustrated in the accompanying drawings. Descriptions of well-known materials, fabrication tools, processing techniques, etc., are omitted so as to not unnecessarily obscure the disclosure in detail. It should be understood, however, that the detailed description and the specific examples, while indicating embodiments of the present disclosure, are given by way of illustration only, and are not by way of limitation. Various substitutions, modifications, additions and/or arrangements within the spirit and/or scope of the underlying concepts will be apparent to those skilled in the art from this disclosure. Reference is made below to the drawings, which are not drawn to scale for ease of understanding, wherein the same reference numbers used throughout different figures designate the same or similar components.

As described in greater detail below, the present disclosure provides apparatus and methods for securing a manhole cover to a manhole frame.

Figure 1:
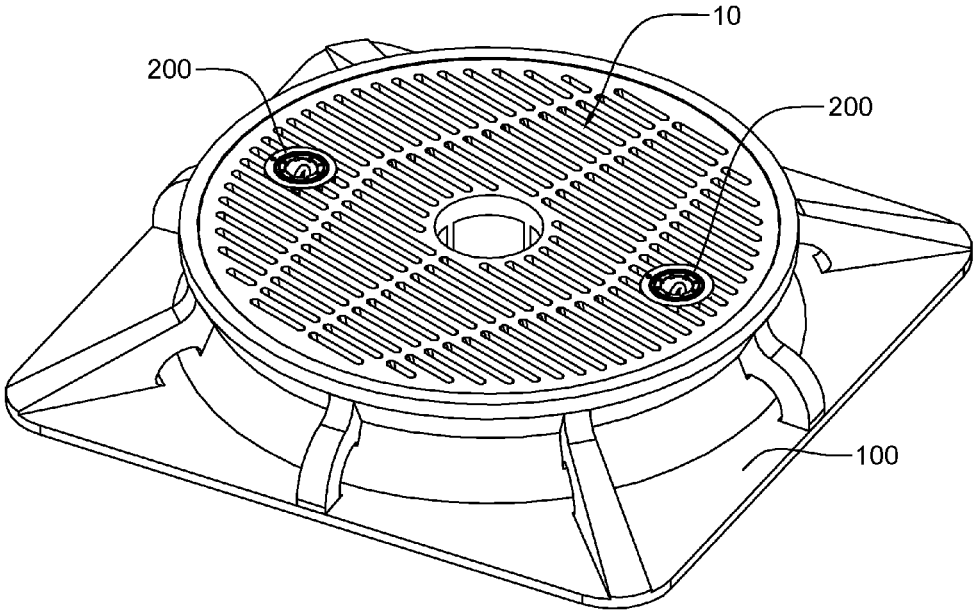
FIG. 1 is a perspective view of a manhole cover having two locking assemblies supported on a manhole frame according to an embodiment of the present disclosure.
Figure 2:
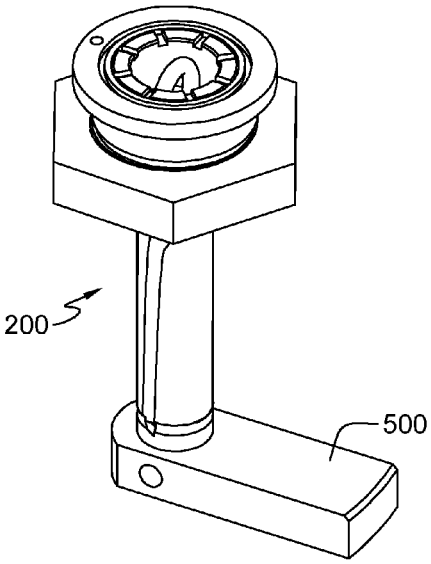
FIG. 2 is a perspective view of one of the locking assemblies of FIG. 1 disposed in a first or lowered locked position.
Figure 3:
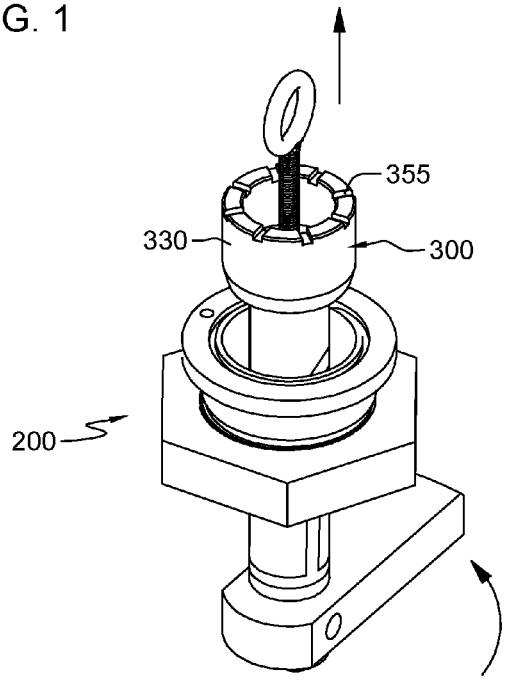
FIG. 3 is a perspective view of one of the locking assemblies of FIG. 1 disposed in a second or raised unlocked position.

FIG. 1 illustrates a manhole cover 10 disposed or positioned on a manhole frame 100 with manhole cover 10 and manhole frame 100 releasably securable to each other via a plurality of locking assemblies 200 according to an embodiment of the present disclosure. In this illustrated embodiment, two locking assemblies 200 may be diametrically arranged and fitted to apertures disposed in manhole cover 10. Locking assemblies 200, one of which is shown in FIG. 2, may be disposable in a first or lowered position having an arm 500 disposed in a generally radially outward orientation relative to manhole cover 10 (FIG. 1) and operable to engage manhole frame 100 (FIG. 1) as described below. Locking assembly 200 may also be disposable in a second or raised position such as shown in FIG. 3 with arm 500 rotated and disposed in a non-radially outward orientation relative to manhole cover 10 (FIG. 1) and operable to allow removal of the manhole cover 10 (FIG. 1) from manhole frame 100 (FIG. 1).

Figure 4:
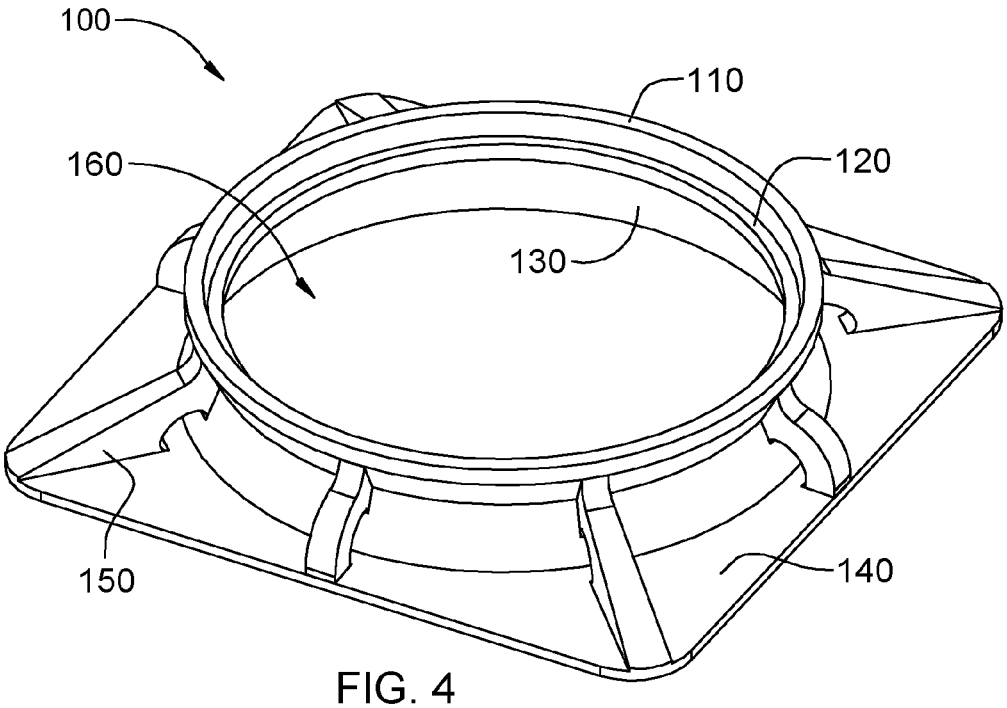
FIG. 4 is a perspective view of the manhole frame of FIG. 1.

With reference to FIG. 4, manhole frame 100 may include an upper rim 110, a lower smaller inset rim 120 that supports the manhole cover, an angled sidewall 130, a lower support 140, and a plurality of gussets 150. Manhole frame 100 may define a circular opening 160 therethough. Manhole frame 100 may be set flush with a paved surface such as a street or parking lot as is known in the art. Manhole frame 100 may be metal casting such as cast iron.

Figure 6:
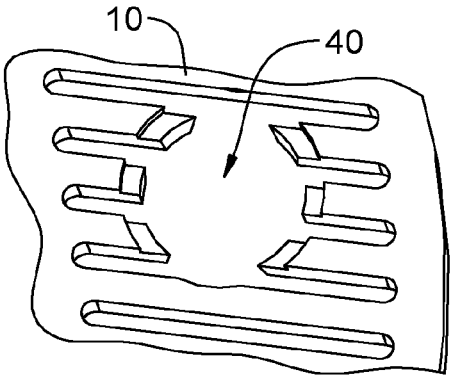
FIG. 6 is an enlarged perspective view of one of the openings in the manhole cover of FIG. 5 for supporting one of the locking assemblies.
Figure 5:
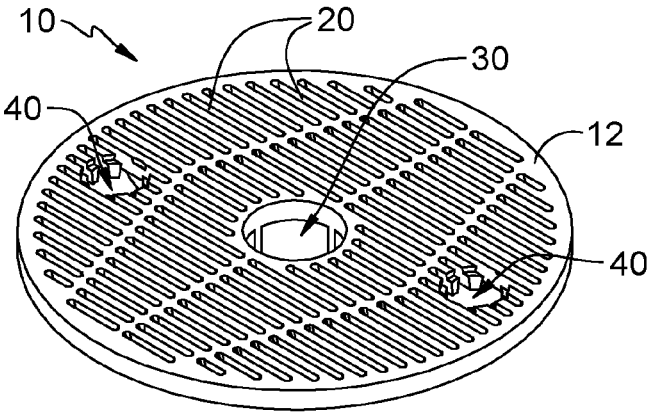
FIG. 5 is a perspective view of the manhole cover of FIG. 1.

As shown in FIG. 5, manhole cover 10 may be an open grate cover having a plurality of elongated openings 20 and a central opening 30. Manhole cover 10 may include a peripheral edge portion 12 sized to be received in rim 110 (FIG. 4) and be supported on inset rim 120 (FIG. 4) of manhole frame 100 (FIG. 4). Manhole cover 10 may include a plurality of openings 40 (further shown in FIG. 6) diametrically arranged adjacent to peripheral edge portion 12, each of which for supporting a respective locking assembly. Manhole cover 10 may be metal casting such as cast iron, or formed from a glass-reinforced plastic, other composite material, or other suitable material or combination thereof. While reference is made to the locking assemblies of the present disclosure being installed in a new manhole cover, it will be appreciated that the locking assemblies of the present disclosure may be installed and operable with existing manhole covers and manhole frames, e.g., retrofitted for use in existing manhole covers and manhole frames.

Figure 7:
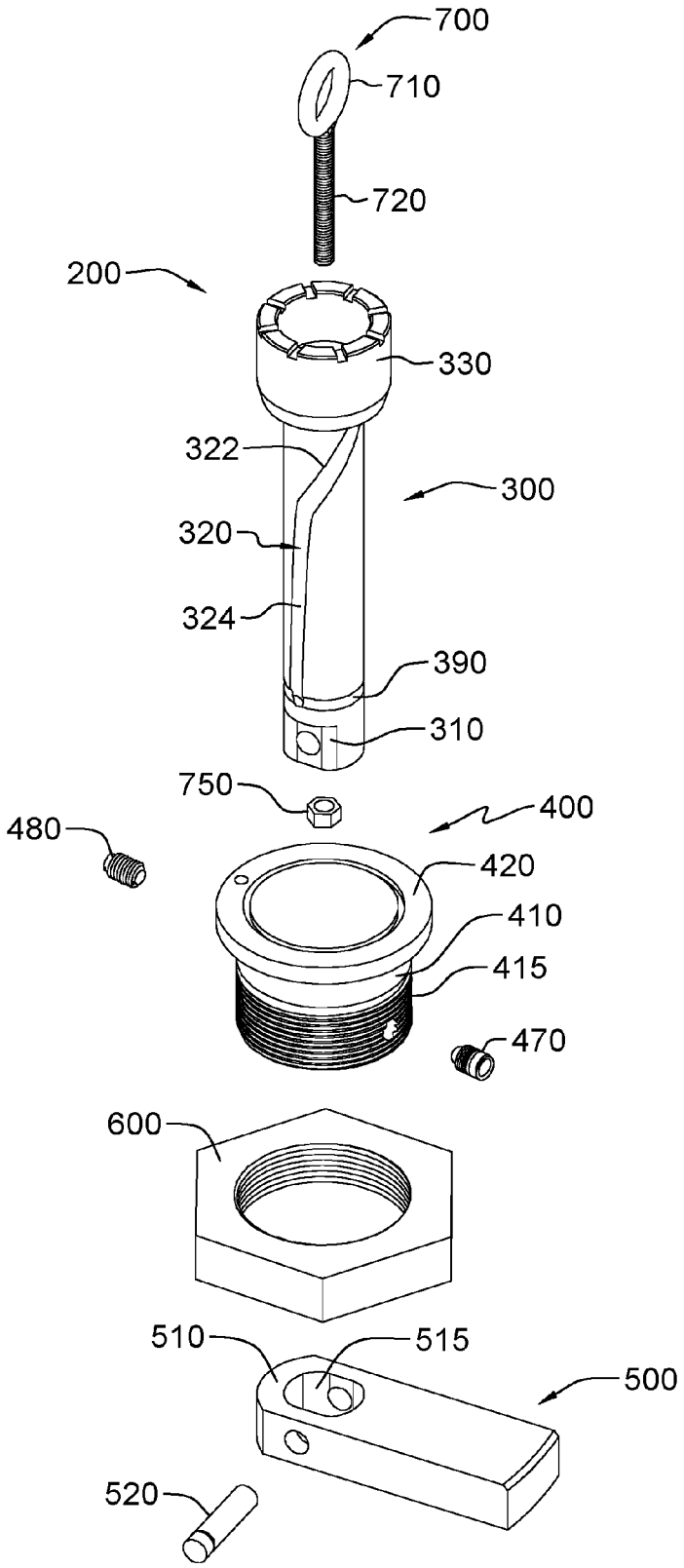
FIG. 7 is an enlarged, exploded perspective view of one of the locking assemblies of FIG. 1.

FIG. 7 illustrates an exploded view of one of locking assemblies 200. Locking assembly 200 may generally include a movable member 300 such as a rod, a bushing 400, and a dog or arm 500. Bushing 400 may include a sidewall 410 having an outwardly-extending flange 420 and external threads 415. A nut 600 having internal threads may be threaded on external threads 415 of bushing 400 to attach locking assembly 200 to manhole cover 10 (FIG. 1). Arm 500 may include a proximal end 510 having an aperture 515 therein sized for receiving a lower end 310 of movable member 300 which may be fixedly secured together with a pin 520. The outer surface portion of movable member 300 may include a recessed groove 320 having a spiral, helix, or curved recessed grooved portion 322 and a generally straight longitudinally-extending recessed grooved portion 324. The outer surface portion of movable member 300 may also include a circumferentially extending groove 390 adjacent end 310 of movable member 300. Movable member 300 may include an upper enlarged head 330, which is receivable in and supportable in bushing 400. A threaded pin 470 is received in and extends through a threaded hole in sidewall 410 of bushing 400. As described below, an end of threaded pin 470 is slidably receivable in groove 320 of movable member 300. A movable detent 480 such as a ball nose spring plunger having external threads extends through a threaded hole in sidewall 410 of bushing 400. As described below, a biased ball at the end of ball nose spring plunger is releasably receivable in circumferentially extending groove 390 of movable member 300. While movable member 300 and arm 500 are illustrated as separate pieces that are fixedly secured together, it will be appreciated that a locking assembly may have a movable member and arm which are integral, one-piece, or monolithic structure.

A swivel 700 is operably connected to movable member 300 with a nut 750. Swivel 700 allows an operator to grasp locking assembly 200 with a hook, and also so that the operator need not have to rotate movable member 300 during extraction or removal of manhole cover 10 (FIG. 1) from manhole frame 100 (FIG. 1). For example, the swivel may have an eye or loop 710 for receiving the hook. An end 720 of swivel 700 may be secured in a passageway in movable member 300 by nut 750 allowing loop 710 to be rotatable. The movable member, arm, bushing, swivel, and nuts may be formed from steel or other suitable material.

Figure 8:
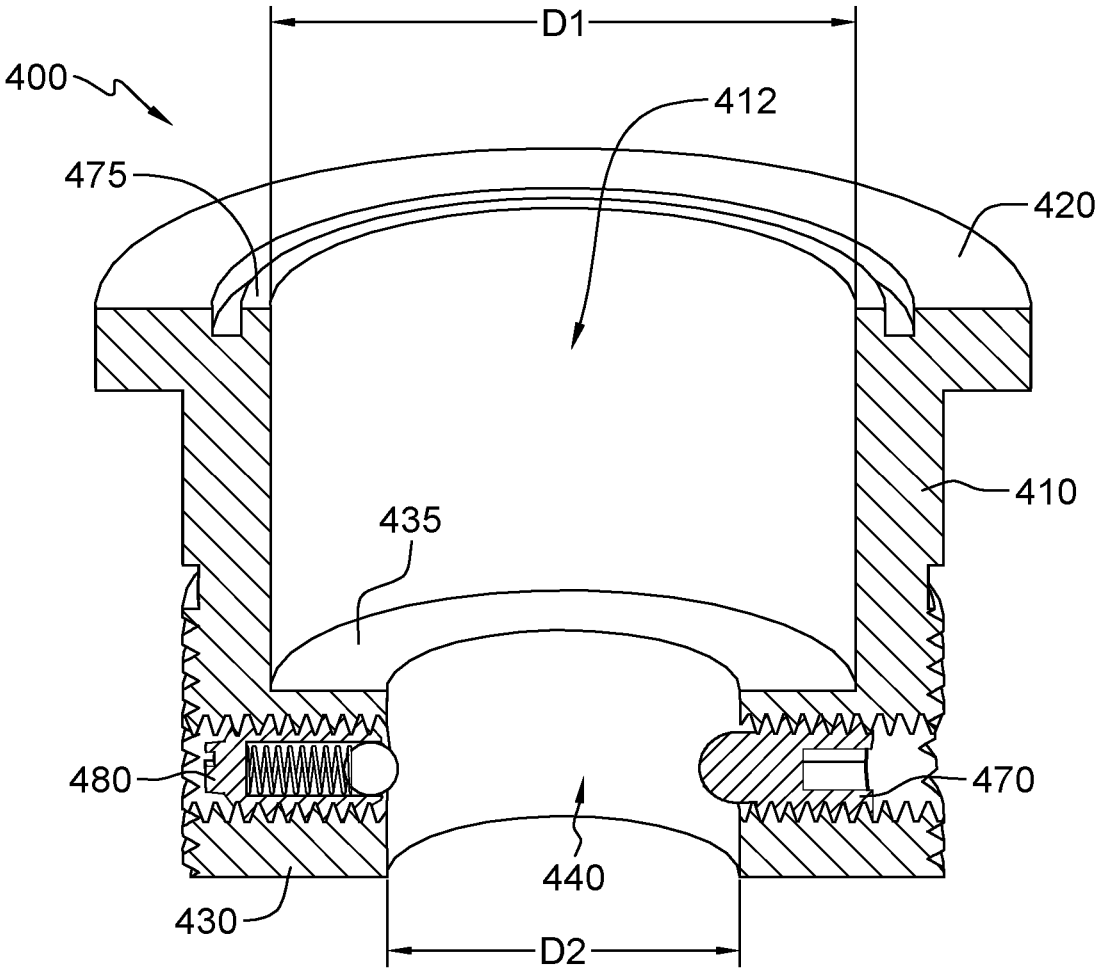
FIG. 8 is an enlarged perspective view, a portion cutaway, of the bushing of the locking assembly of FIG. 7.

As further shown in FIG. 8, bushing 400 may have a generally hollow cylindrical configuration. For example, bushing 400 may include sidewall 410 defining a cavity 412 therein have a first diameter D1, outwardly-extending rim 420, and a bottom wall 430 having an opening 440 therein having a second diameter D2 sized smaller than first diameter D1 so that bottom wall 430 forms a stop 435. Threaded holes extend through bottom wall 430, one for receiving threaded pin 470 and the other for receiving ball nose spring plunger 480.

Figure 9:
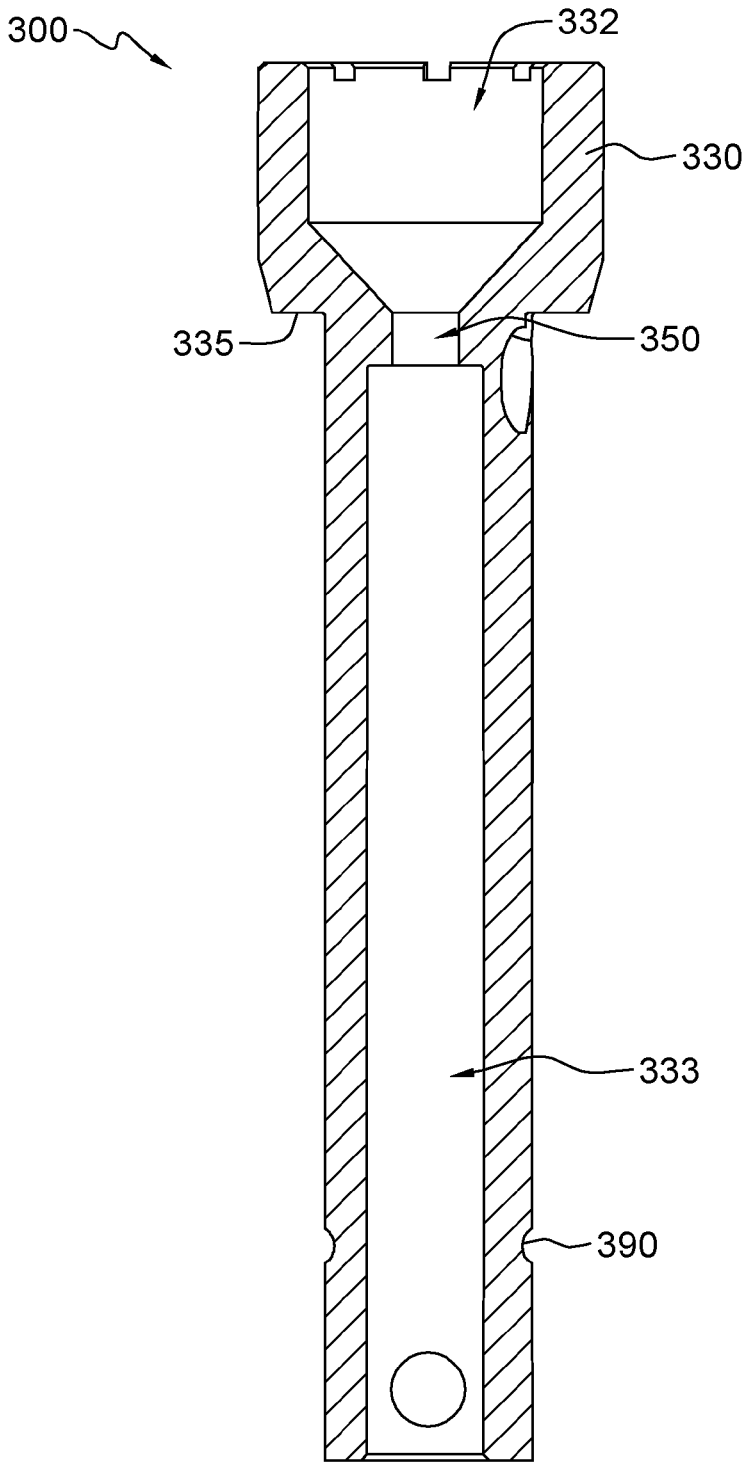
FIG. 9 is an enlarged cross-sectional view of the movable member of the locking assembly of FIG. 7.

FIG. 9 further illustrates movable member 300. For example, movable member 300 may have a generally hollow configuration. Upper enlarged head 330 may have a cavity 332 therein having a diameter sized for receiving loop 710 (FIG. 7) of swivel 700. A lower portion of movable member 300 may have a cavity 333 therein. Disposed between cavities 332 and 333 may be reduced diameter passageway 350 sized for receiving end 720 (FIG. 7) of swivel 700 (FIG. 7). Cavity 333 may be sized so that nut 750 (FIG. 7) is easily received therein and attached to end 720 (FIG. 7) of swivel 700 (FIG. 7). A lower portion of upper enlarged head 330 may define a stop 335 which is supported on stop 435 (FIG. 8) of bushing 400 (FIG. 8).

As described above, withdrawing the movable member of locking assembly upwardly relative to the bushing and the manhole cover, or lowering the movable member of the locking assembly and relative to the bushing and manhole cover causes a rotation of the movable member and the arm.

Figure 10:
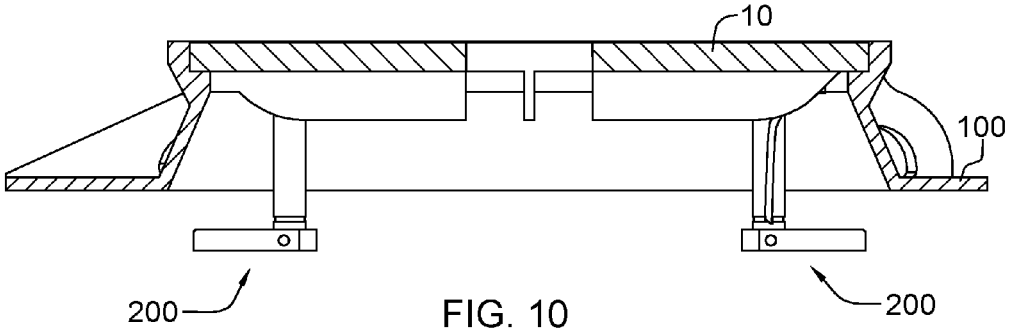
FIG. 10 is a cross-sectional view of the two locking assemblies along with a portion of the manhole cover of FIG. 1, in which the locking assemblies are disposed in a first or lowered locked position.

With reference to FIG. 10, FIG. 10 illustrates two locking assemblies 200 attached to manhole cover 10 in which locking assemblies 200 are disposed in a lowered locked position. The two locking assemblies may be diametrically arranged and fitted to apertures disposed in the manhole cover which manhole cover may be a new cover or an existing cover. It will be appreciated that in other embodiments, only one locking assembly 200 may be employed for locking and releasably locking manhole cover 10 to manhole frame 100. For example, a fixed non-movable locking member may be attached to manhole cover, e.g., in place of the locking assembly disposed on the left as shown in FIG. 10. In another example, a manhole cover may be formed with a fixed non-movable locking member, e.g., in place of the locking assembly disposed on the left as shown in FIG. 10

Figure 11:
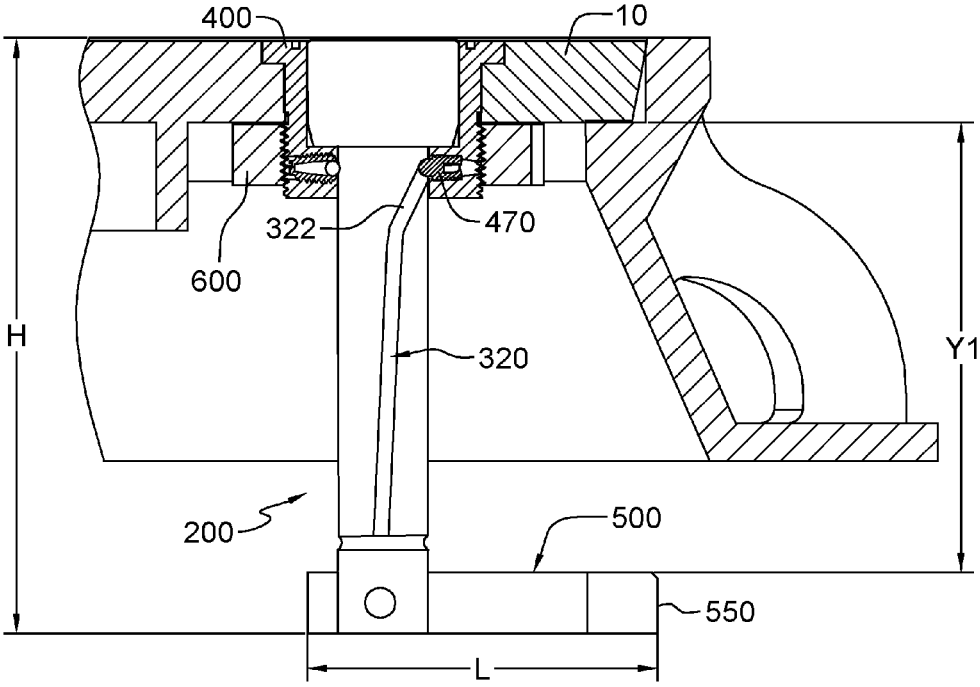
FIG. 11 is an enlarged cross-sectional view of the locking assembly along with a portion of the manhole cover of FIG. 10, in which the locking assembly is disposed in the first or lowered locked position.

FIG. 11 illustrates locking assembly 200 along with a portion of the manhole cover of FIG. 10, in which the locking assembly is disposed in a lowered locked position. Bushing 400 is fitted in aperture 40 (FIG. 6) and secured with nut 600. In other embodiments, a bushing may be welded to a manhole cover. Where the manhole cover is a non-metallic cover, a bushing may be suitably bonded with a suitable bonding material. The bushing provides a transition from manhole cover 10 to and for receiving movable member 300. Bushing 300 may make the locking assembly adaptable to any cover.

The weight of the locking assembly of about 7 pounds to about 13 pounds, or about 10 pounds, results in the locking assembly being disposed in a generally lowered locking position under the influence of gravity. In some embodiments, bushing 400 as shown in FIG. 8 may have a peening land 475 and upper enlarged head 330 (FIG. 3) of movable member 300 (FIG. 3) may have an accompanying groove or cutout 355 (FIG. 3). If the manhole cover needs to be secured against unauthorized access, either from above or below grade, a portion (e.g., 2, 3, 4 or more portions) thereof land 475 on bushing 400 may be peened into cutouts 355 (FIG. 3) of movable member 300 (FIG. 3). This prevents the movable member from being withdrawn from the bushing. The peened metal may need to be ground away or otherwise removed or forced from the cutouts in order to withdraw the movable member and remove the manhole cover from the manhole frame.

Figure 12:
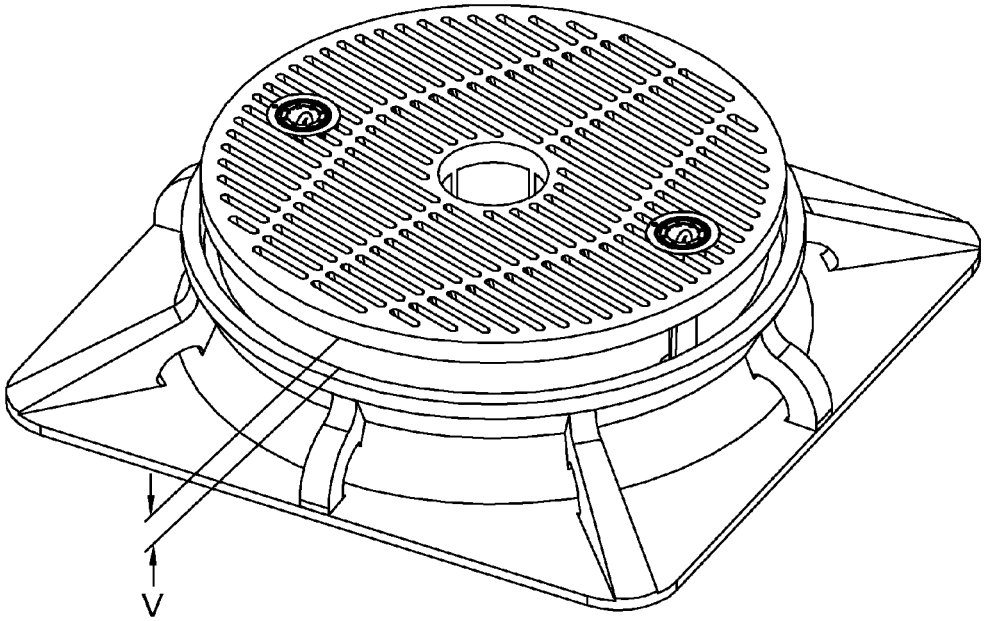
FIG. 12 is a perspective view of the manhole cover having two locking assemblies supported on the manhole frame of FIG. 1 in the first or lowered locked position and in the event of an explosion below the manhole cover acting to raise the manhole cover relative to the manhole frame.
Figure 13:
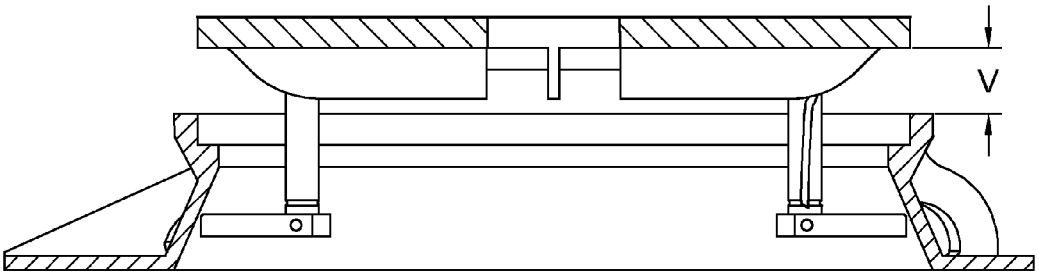
FIG. 13 is a cross-sectional view of the manhole cover having the two locking assemblies in the lowered locked position engaging the manhole frame of FIG. 12.

In the lowered locking position, pin 470 is disposed in an upper spiral or helix groove portion 322 of groove 320 of movable member 300 so that arm 500 is disposed in a radially outward direction relative to manhole cover 10. The length L of arm 500 and the height H of movable member 300 are sized and selected so that a distal end 550 will engage manhole frame 100 if manhole cover 10 is raised more than a certain vertical distance V as best shown in FIGS. 12 and 13. In some embodiments, in the lowered locked position, radially disposed distal end 550 of arm 500 may extend past the peripheral edge of the manhole cover. In other embodiments, if the manhole frame includes structure disposed inward from the peripheral edge of the manhole cover, radially disposed distal end 510 of arm 500 need not extend past the peripheral edge of the manhole cover in the lowered locked position. As further described below, this feature provides an outlet for explosive energy that might otherwise fracture the manhole cover resulting in projectiles.

With reference again to FIG. 11, when the locking assembly is disposed in a lowered locked position, a top portion of movable member 300 may be generally level or flush with a top surface of manhole cover 10 and arm 300 may be disposed in a position to engage manhole frame 100 and prevent the cover from being removed. For example, arm 500 may be disposed at a first distance Y1 and a first radial orientation relative to a bottom surface of manhole cover 10. Authorized personnel can tell at a glance whether the cover is properly secured, e.g., by the top of the locking assembly being level with the top of the manhole cover.

Figure 14:
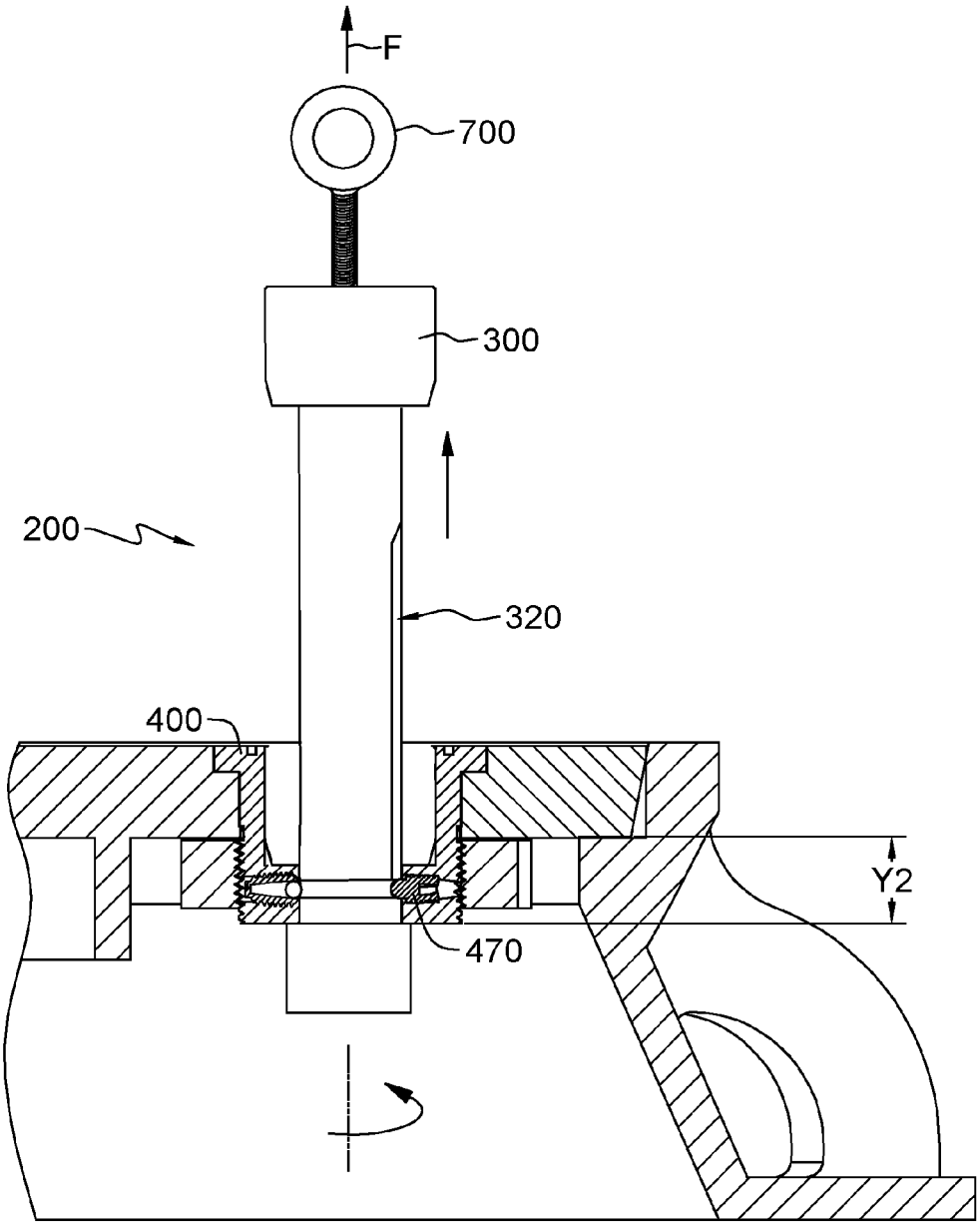
FIG. 14 is an enlarged cross-sectional view of one of the locking assemblies along with a portion of the manhole cover of FIG. 11, in which the locking assembly is disposed in a second or raised unlocked position.
Figure 15:
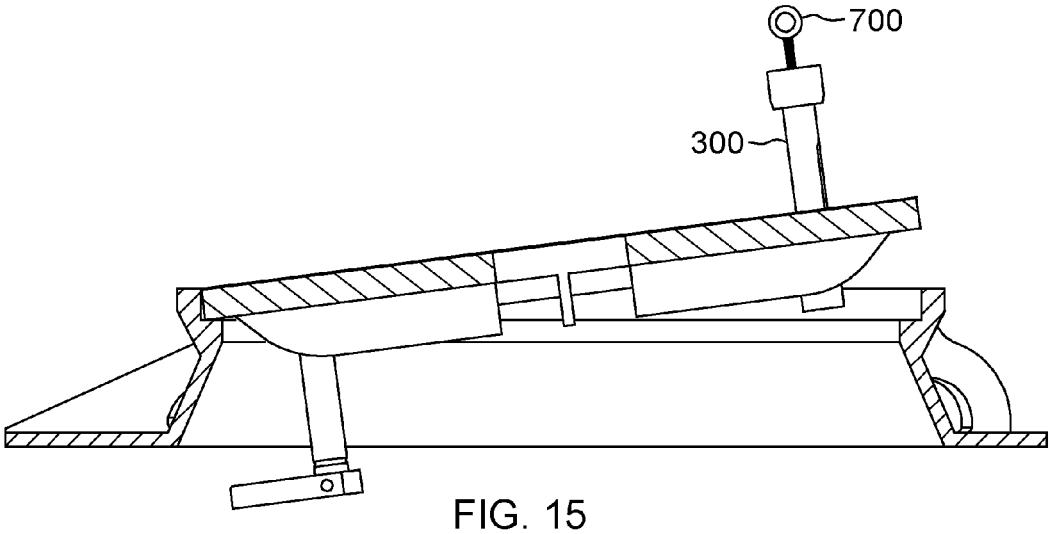
FIG. 15 is a cross-sectional view of the manhole cover, locking assemblies, and manhole frame of FIG. 10, with one of the locking assemblies disposed in a raised unlocked position and with the manhole cover being tilted for removal from the manhole frame.

As shown in FIG. 14, raising movable member 300 of locking assembly 200 forces movable member 300 to rotate about 90 degrees (e.g., groove 320 moving along pin 470) moving arm 500 inwardly toward the center of manhole cover 10 and away from engagement with manhole frame 100 and allowing manhole cover 10 to be removed, for example as shown in FIG. 15. For example, arm 500 may be disposed at a second distance Y2 and a second non-radial orientation relative to a bottom surface of manhole cover 10. Second distance Y2 may be less the first distance Y1 (FIG. 11) A standard lifting hook typically used to pull a manhole cover out of a manhole frame may be used to engage and apply an upward force F on swivel 700 to raise swivel 700, and thus raise, apply an upward force on movable member 300. Therefore, no additional or special tools are required to remove the manhole cover from the manhole frame. The manhole cover may be easily and safely removed even under emergency conditions such as a steam leak or fire below. Utility personnel can stand safely away from the manhole cover but sufficiently close to reach it with a standard hook tool, operate the lock(s), and remove the manhole cover from the manhole frame with one or two motions.

With reference again to FIG. 14, a portion of groove 320 may have about a 90 degree spiral, helix, or curved groove 322 (FIG. 7) that allows movable member 300 to rotate about 90 between the raised unlocked position and the lowered locked position.

With reference again to FIG. 8, a biased ball at the end of ball nose spring plunger 480 is releasably receivable in circumferentially extending groove 390 (FIG. 9) of movable member 300 to maintain locking assembly 200 as shown in FIG. 14 in a raised unlocked position. Maintaining locking assembly 200 in a raised unlocked position results in arm 500 generally not being engageable with the ground when the cover is removed and placed on the ground. As shown in FIG. 8, the end of pin 470 may be sized larger than the end of ball nose spring plunger 480 so that pin 470 remains disposed in groove 320 in both the lowered and raised positions. The groove may have a long straight portion beyond the spiral, helix, or curved portion enabling the pin to remain engaged with the groove throughout the range of operation. This feature maintains the alignment of the movable member relative to the bushing, and thus, relieves the operator of the need to align the movable member and arm relative to the manhole cover when locking and unlocking the manhole cover form the manhole frame.

Figure 16:
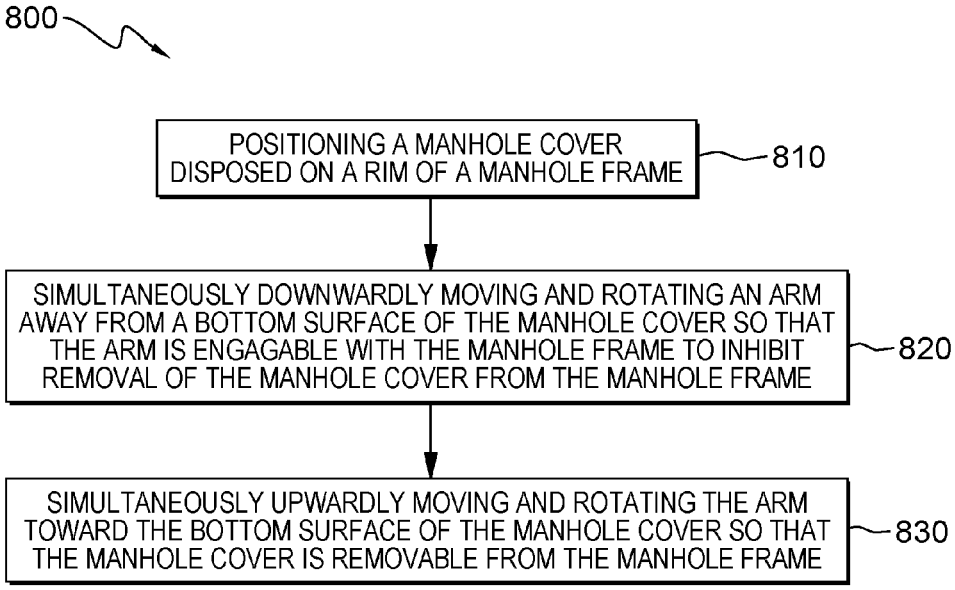
FIG. 16 is a flowchart of a method for locking a manhole cover to a manhole frame.

FIG. 16 illustrates a method 800 according to an embodiment for locking and unlocking a manhole cover to a manhole frame. Method 800 may include at 810 positioning a manhole cover disposed on a rim of a manhole frame, at 820 simultaneously downwardly moving and rotating an arm away from a bottom surface of the manhole cover so that the arm is engageable with the manhole frame to inhibit removal of the manhole cover from the manhole frame, and at 830 simultaneously upwardly moving and rotating the arm toward the bottom surface of the manhole cover so that the manhole cover is removable from the manhole frame.

As will be appreciated, the present disclosure may provide a secure manhole covers and methods that are simple, rugged, retrofittable, provides an obvious indication of engagement, and allows explosion products to escape. Some currently available devices require that the embedded manhole frame be replaced as well as the cover, making the transition very expensive and time consuming. Other approaches are complicated and prone to failure or seizing.

As described above, a spring device or biased detent may be included to hold the locking movable member in a raised unlocked position. This ensures that the movable member (movable members, for example, when two locking assemblies are used for a manhole cover) will not interfere with removing the cover from the hole, and also protect the locking assembly from damage when the cover is dragged away from the hole. When an unlocked manhole cover is placed on a manhole frame, the movable member may transition to the lower locked position with a slight tap on the movable member, e.g., disengage the spring device or biased detent from the circumferentially extending groove 390 (FIG. 7).

As described above, the spiral, helix, or curved groove is disposed in the movable member and the pin that rides in the groove is disposed in the bushing. The bushing has two threaded holes, one for a pin that rides in the groove, and one for a ball spring plunger that engages a circumferential groove in the movable member, e.g., as described above. For example, a ball spring plunger is operable to hold the movable member in a raised unlocked position. The ball spring plunger may be employed for restraining the movable member in a lower position, however the weight of the locking assembly may be sufficient for maintaining the locking assembly in the lower locked position. In other embodiments, a locking assembly may have a bushing or a sleeve therein with a spiral, helix or curved cutout or groove, and a movable member may have pin that extends outwardly from the movable member. Such a pin and groove may allow the locking assembly to be positioned in a lowered locked position or a raised unlocked position by the pin riding in the groove.

As will be appreciated from the description above, any cover, regardless of material or size, may be fitted with one or a plurality of locking assemblies of the present disclosure. For example, the apertures may be holes that are cut into existing manhole covers or holes formed as part of a pattern of a new cast manhole cover.

It is to be understood that the above description is intended to be illustrative, and not restrictive. For example, the above-described embodiments and/or aspects thereof may be used in combination with each other. In addition, many modifications may be made to adapt a particular situation or material to the teachings of the various embodiments without departing from their scope.

While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the disclosure has been described in detail in connection with only a limited number of embodiments, it should be readily understood that the disclosure is not limited to such disclosed embodiments. Rather, the disclosure can be modified to incorporate any number of variations, alterations, substitutions, or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

This written description uses examples in the present disclosure, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A locking assembly for a manhole cover, said locking assembly comprising:

a movable member having an upper portion and a lower portion, said upper portion supportable in an opening in a manhole cover adjacent to a peripheral edge of the manhole cover;

an arm extending outwardly from said lower portion of said movable member and disposable below a bottom surface of the manhole cover;

a swivel disposed in a cavity in said upper portion of said movable member;

wherein said movable member and said arm are disposable in a lowered position relative to the manhole cover with said arm engageable with a portion of a manhole frame below the manhole cover to inhibit removal of the manhole cover from the manhole frame; and wherein said movable member and said arm are disposable in a raised position relative to the manhole cover with said arm so that the manhole cover is removable from the manhole frame.

2. The locking assembly of claim 1 wherein said movable member is rotatable between said lowered position and said raised position.

3. The locking assembly of claim 1 wherein said lowered position comprises said arm disposed at a first distance and at a first orientation relative to a bottom surface of the manhole cover, and said raised position comprises said arm disposed at a second distance less than said first distance and at a second orientation different from said first orientation relative to a bottom surface of the manhole cover.

4. The locking assembly of claim 1 wherein said movable member comprises a longitudinally extending groove along a surface of said movable member, said groove engageable with a pin for rotatably moving said movable member between said lowered position and said raised position.

5. The locking assembly of claim 4 wherein at least a portion of said groove comprises a longitudinally extending spiral, helix, or curved groove.

6. The locking assembly of claim 4 further comprising a bushing disposed in the opening of the manhole cover, said bushing having a passageway for receiving said movable member, and further comprising a pin extending from said bushing and receivable in said groove.

7. The locking assembly of claim 6 wherein said bushing comprises an upper flange and a lower threaded portion, and further comprising a threaded nut receivable on said lower threaded portion of said bushing.

8. The locking assembly of claim 1 wherein said swivel comprises an eye for receiving a hook.

9. The locking assembly of claim 1 wherein said swivel is retractable and disposable in said cavity of said upper portion of said movable member in said lowered position.

10. The locking assembly of claim 1 wherein said lowered position comprises said arm disposed in a radially outward-extending orientation relative to the manhole cover, and wherein said raised position comprises said arm disposed in a non-radially outward-extending orientation relative to the manhole cover.

11. The locking assembly of claim 1 wherein said locking assembly in said lowered position is operable to provide a gap between a peripheral-extending edge of the manhole cover and the manhole frame while inhibiting removal of the manhole cover from the manhole frame.

12. The locking assembly of claim 1 wherein said locking assembly is weighted so that said arm is maintained in said lowered position under a force of gravity.

13. The locking assembly of claim 1 wherein said movable member and said arm comprises a weight between about 7 pounds to about 13 pounds.

14. The locking assembly of claim 1 further comprising a spring biased detent for restraining said movable member in said raised position.

15. A lockable manhole cover comprising:

a manhole cover; and a locking assembly of claim 1 attachable to said manhole cover.

16. The lockable manhole cover of claim 15 further comprising a manhole frame.

17. A method comprising:

providing the locking assembly of claim 1 attached to the manhole cover in the raised position;

positioning the manhole cover on a rim of the manhole frame; and moving the locking assembly to the lowered position to lock the manhole cover to the manhole frame.

18. The locking assembly of claim 1 wherein said movable member and arm being movable between said lowered position and said raised position comprises a pin movable in a curved groove.

19. A locking assembly for a manhole cover, said locking assembly comprising:

means, attachable to a manhole cover, for simultaneously moving and rotating an arm from a lowered position with said arm disposed at a first distance and at a first orientation relative to a bottom surface of the manhole cover so that said arm is engageable with a portion of a manhole frame to inhibit removal of the manhole cover from the manhole frame to a raised position with said arm disposed at a second distance less than said first distance and at a second orientation different from said first orientation relative to a bottom surface of the manhole cover so that the manhole cover is removable from the manhole frame;

said means for simultaneously moving and rotating said arm comprises a pin movable in a groove; and wherein at least a portion of said groove comprises a curved longitudinally extending groove.

20. The locking assembly of claim 19 wherein said locking assembly is weighted so that said means for simultaneously moving and rotating an arm is maintained in said lowered position under a force of gravity.

21. The locking assembly of claim 19 further comprising means for maintaining said locking assembly in said raised position.

22. A lockable manhole cover comprising:

a manhole cover; and a locking assembly of claim 19 attachable to said manhole cover.

23. The lockable manhole cover of claim 22 further comprising a manhole frame.

24. A method comprising:

providing the locking assembly of claim 19 attached to the manhole cover in the raised position;

positioning the manhole cover on a rim of the manhole frame; and moving the locking assembly to the lowered position to lock the manhole cover to the manhole frame.

25. A locking assembly for a manhole cover, said locking assembly comprising:

a bushing attachable through an opening in the manhole cover adjacent to a peripheral edge, said bushing have a passageway therein;

a pin inwardly extending into the passageway in said bushing;

a movable member receivable in said bushing, said movable member having a groove for receiving said pin therein;

an outwardly-extending arm attached to a lower portion of said movable member;

wherein said locking assembly is disposable with said pin in said groove in a lowered position with said outwardly-extending arm disposed in a generally radially outward orientation operable to engage a frame supporting the manhole cover to inhibit removal of the manhole cover from the manhole frame, and wherein said locking assembly is disposable with said pin in said groove in a raised position with said outwardly extending arm disposed in a non-radially outwardly-extending orientation operable to allow removal of the manhole cover from the manhole frame.

26. The manhole locking assembly of claim 25 wherein at least a portion of said groove comprises a longitudinally extending spiral, helix, or curved groove.

27. The manhole locking assembly of claim 25 wherein said locking assembly is weighted so that said means for simultaneously moving and rotating an arm is maintained in said lowered position under a force of gravity.

28. A lockable manhole cover comprising:

a manhole cover; and a locking assembly of claim 25 attachable to said manhole cover.

29. A method comprising:

providing the locking assembly of claim 25 attached to the manhole cover in the raised position;

positioning the manhole cover on a rim of the manhole frame; and moving the locking assembly to the lowered position to lock the manhole cover to the manhole frame.

30. A method comprising:

positioning a manhole cover disposed on a rim of a manhole frame;

simultaneously downwardly moving and rotating an arm away from a bottom surface of the manhole cover so that the arm is disposed in a generally radially outward orientation relative to the manhole cover and engageable with the manhole frame to inhibit removal of the manhole cover from the manhole frame;

simultaneously upwardly moving and rotating the arm toward the bottom surface of the manhole cover so that the arm is disposed in a non-radially outwardly-extending orientation relative to the manhole cover and the manhole cover is removable from the manhole frame; and wherein the simultaneously downwardly moving and rotating comprises simultaneously downwardly moving and rotating the arm away from the bottom surface of the manhole cover under a force of gravity.

31. A locking assembly for a manhole cover, said locking assembly comprising:

a movable member having an upper portion and a lower portion, said upper portion supportable in an opening in a manhole cover adjacent to a peripheral edge of the manhole cover;

an arm extending outwardly from said lower portion of said movable member and disposable below a bottom surface of the manhole cover;

wherein said movable member and said arm are disposable in a lowered position relative to the manhole cover with said arm engageable with a portion of a manhole frame below the manhole cover to inhibit removal of the manhole cover from the manhole frame;

wherein said movable member and said arm are disposable in a raised position relative to the manhole cover with said arm so that the manhole cover is removable from the manhole frame; and wherein said movable member and arm being movable between said lowered position and said raised position comprises a pin movable in a curved groove.

32. The locking assembly of claim 31 wherein said movable member comprises said curved groove disposed along a surface of said movable member, said groove engageable with said pin for rotatably moving said movable member between said lowered position and said raised position.

33. The locking assembly of claim 31 wherein said lowered position comprises said arm disposed in a radially outward-extending orientation relative to the manhole cover, and wherein said raised position comprises said arm disposed in a non-radially outward-extending orientation relative to the manhole cover.

34. The locking assembly of claim 31 wherein said locking assembly in said lowered position is operable to provide a gap between a peripheral-extending edge of the manhole cover and the manhole frame while inhibiting removal of the manhole cover from the manhole frame.

35. A lockable manhole cover comprising:

a manhole cover; and a locking assembly of claim 31 attachable to said manhole cover.

36. The lockable manhole cover of claim 35 further comprising a manhole frame.

37. A method comprising:

providing the locking assembly of claim 31 attached to the manhole cover in the raised position;

positioning the manhole cover on a rim of the manhole frame; and moving the locking assembly to the lowered position to lock the manhole cover to the manhole frame.

* * * * *